US008337278B2

(12) United States Patent
Palou-Rivera et al.

(10) Patent No.: US 8,337,278 B2
(45) Date of Patent: Dec. 25, 2012

(54) WAFER EDGE CHARACTERIZATION BY SUCCESSIVE RADIUS MEASUREMENTS

(75) Inventors: Ignasi Palou-Rivera, Flossmoor, IL (US); Boguslaw A. Swedek, Cupertino, CA (US); Lakshmanan Karuppiah, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1006 days.

(21) Appl. No.: 12/203,726

(22) Filed: Sep. 3, 2008

(65) Prior Publication Data

US 2009/0149115 A1 Jun. 11, 2009

Related U.S. Application Data

(60) Provisional application No. 60/974,783, filed on Sep. 24, 2007.

(51) Int. Cl.
*B24B 49/00* (2012.01)

(52) U.S. Cl. ..... 451/8; 451/41; 451/287

(58) Field of Classification Search ..... 451/5, 8, 451/41, 285–290

See application file for complete search history.

(56) References Cited

U.S. PATENT DOCUMENTS

| | | | | |
|---|---|---|---|---|
| 4,005,359 | A | | 1/1977 | Smoot |
| 4,112,365 | A | | 9/1978 | Larson et al. |
| 4,207,520 | A | | 6/1980 | Flora et al. |
| 4,209,744 | A | | 6/1980 | Gerasimov et al. |
| 4,302,721 | A | | 11/1981 | Urbanek et al. |
| 4,303,885 | A | | 12/1981 | Davis et al. |
| 4,467,281 | A | | 8/1984 | Davis et al. |
| 4,556,845 | A | | 12/1985 | Stope et al. |
| 4,593,244 | A | | 6/1986 | Summers et al. |
| 4,609,870 | A | | 9/1986 | Lale et al. |
| 4,673,877 | A | | 6/1987 | Sakamoto et al. |
| 4,715,007 | A | | 12/1987 | Fujita et al. |
| 4,716,366 | A | | 12/1987 | Hosoe et al. |
| 4,766,374 | A | | 8/1988 | Glass et al. |
| 4,819,167 | A | * | 4/1989 | Cheng et al. ..... 700/59 |
| 4,829,251 | A | | 5/1989 | Fischer |
| 4,849,694 | A | | 7/1989 | Coates |
| 4,880,348 | A | | 11/1989 | Baker et al. |

(Continued)

FOREIGN PATENT DOCUMENTS

DE 4227734 2/1994

(Continued)

OTHER PUBLICATIONS

Nonaka, Yoshihiro, "A Double Coil Method for Simultaneously Measuring the Resistivity Permeability and Thickness of a Moving Metal Sheet", *IEEE Transactions on Instrumentation and Measurement*, vol. 45, No. 2 (Apr. 2, 1996), pp. 478-482.

*Primary Examiner* — Maurina Rachuba
(74) *Attorney, Agent, or Firm* — Fish & Richardson P.C.

(57) ABSTRACT

Systems and methods for performing one or more measurements of a substrate at one or more radii along the substrate are described. Thickness measurements taken at various radii along the substrate can be averaged together to obtain an average value that reflects an overall substrate thickness. A more accurate measurement of the overall substrate thickness can be obtained by performing multiple measurements and averaging the measurements together. Using the average value, polishing can be adjusted to ensure that the substrate achieves a desired planarized thickness profile.

33 Claims, 10 Drawing Sheets

U.S. PATENT DOCUMENTS 4,881,031 A 11/1989 Pfisterer et al.
4,943,446 A 7/1990 Isherwood et al.
4,963,500 A 10/1990 Cogan et al.
4,977,853 A 12/1990 Falcoff et al.
5,001,356 A 3/1991 Ichikawa
5,003,262 A 3/1991 Egner et al.
5,081,796 A 1/1992 Schultz
5,140,265 A 8/1992 Sakiyama et al.
5,213,655 A 5/1993 Leach et al.
5,237,271 A 8/1993 Hedengren
5,270,222 A 12/1993 Moslehi
5,323,951 A 6/1994 Takechi et al.
5,343,146 A 8/1994 Koch et al.
5,355,083 A 10/1994 George et al.
5,357,331 A 10/1994 Flockencier
5,396,050 A 3/1995 Ebihara et al.
5,413,941 A 5/1995 Koos et al.
5,427,878 A 6/1995 Corliss
5,433,651 A 7/1995 Lustig
5,451,863 A 9/1995 Freeman
5,485,082 A 1/1996 Wisspeintner et al.
5,511,005 A 4/1996 Abbe et al.
5,525,903 A 6/1996 Mandl et al.
5,534,289 A 7/1996 Bilder et al.
5,541,510 A 7/1996 Danielson
5,559,428 A 9/1996 Li et al.
5,605,760 A 2/1997 Roberts
5,609,511 A 3/1997 Moriyama
5,640,242 A 6/1997 O'Boyle et al.
5,644,221 A 7/1997 Li et al.
5,658,183 A * 8/1997 Sandhu et al. ..... 451/5
5,660,672 A 8/1997 Li et al.
5,663,797 A 9/1997 Sandhu
5,672,091 A * 9/1997 Takahashi et al. ..... 451/6
RE35,703 E 12/1997 Koch et al.
5,708,506 A 1/1998 Birang
5,719,495 A 2/1998 Moslehi
5,730,642 A 3/1998 Sandhu et al.
5,731,697 A 3/1998 Li et al.
5,733,171 A 3/1998 Allen et al.
5,762,537 A 6/1998 Sandhu et al.
5,791,969 A 8/1998 Lund
5,807,165 A 9/1998 Uzoh et al.
5,822,213 A 10/1998 Huynh
5,838,447 A 11/1998 Hiyama et al.
5,851,135 A 12/1998 Sandhu et al.
5,865,666 A 2/1999 Nagahara
5,872,633 A 2/1999 Holzapfel et al.
5,886,521 A 3/1999 Hassan
5,889,401 A 3/1999 Jourdain et al.
5,893,796 A 4/1999 Birang et al.
5,899,792 A 5/1999 Yagi
5,911,619 A 6/1999 Uzoh et al.
5,913,713 A 6/1999 Cheek et al.
5,917,601 A 6/1999 Shimazaki et al.
5,929,994 A 7/1999 Lee et al.
5,948,203 A 9/1999 Wang
5,949,927 A 9/1999 Tang
5,964,643 A 10/1999 Birang et al.
6,004,187 A 12/1999 Nyui et al.
6,034,781 A 3/2000 Sarfaty et al.
6,068,539 A 5/2000 Bajaj et al.
6,071,178 A 6/2000 Baker, III
6,120,348 A 9/2000 Fujita et al.
6,159,073 A 12/2000 Wiswesser et al.
6,179,709 B1 1/2001 Redeker et al.
6,190,234 B1 2/2001 Swedek et al.
6,254,459 B1 7/2001 Bajaj et al.
6,271,670 B1 8/2001 Caffey
6,280,289 B1 8/2001 Wiswesser et al.
6,281,679 B1 8/2001 King et al.
6,296,548 B1 10/2001 Wiswesser et al.
6,309,276 B1 10/2001 Tsai et al.
6,407,546 B1 6/2002 Le et al.
6,413,145 B1 7/2002 Pinson, II et al.
6,431,949 B1 8/2002 Ishikawa et al.
6,433,541 B1 8/2002 Lehman et al.
6,448,795 B1 9/2002 Ermakov et al.
6,458,014 B1 10/2002 Ihsikawa et al.
6,563,308 B2 5/2003 Nagano et al.
6,575,825 B2 6/2003 Tolles et al.
6,578,893 B2 6/2003 Soucy et al.
6,586,337 B2 7/2003 Parikh
6,608,495 B2 8/2003 Sarfaty et al.
6,621,264 B1 9/2003 Lehman et al.
6,633,159 B1 10/2003 Robar et al.
6,650,106 B2 11/2003 Daalmans et al.
6,670,808 B2 12/2003 Nath et al.
6,700,370 B2 3/2004 Chen et al.
6,707,540 B1 3/2004 Lehman et al.
6,710,886 B2 3/2004 Park et al.
6,753,964 B2 6/2004 Chen et al.
6,774,624 B2 8/2004 Anderson et al.
6,803,757 B2 10/2004 Slates
6,808,590 B1 10/2004 Gotkis et al.
6,811,466 B1 11/2004 Swedek et al.
6,850,053 B2 2/2005 Daalmans et al.
6,885,190 B2 4/2005 Lehman et al.
6,917,433 B2 7/2005 Levy et al.
6,924,641 B1 8/2005 Hanawa et al.
6,939,198 B1 9/2005 Swedek et al.
7,042,558 B1 5/2006 Sarfaty et al.
7,084,621 B2 8/2006 Gotkis et al.
7,112,960 B2 9/2006 Miller et al.
7,112,961 B2 9/2006 Lei et al.
7,128,803 B2 * 10/2006 Owczarz et al. ..... 156/345.13
7,262,867 B2 8/2007 Lasagni
7,309,618 B2 12/2007 Gotkis et al.
7,355,394 B2 4/2008 Lei et al.
2001/0008827 A1 7/2001 Kimura et al.
2001/0054896 A1 12/2001 Mednikov et al.
2002/0002029 A1 1/2002 Kimura et al.
2002/0013124 A1 1/2002 Tsujimura et al.
2002/0077031 A1 6/2002 Johansson et al.
2002/0098777 A1 7/2002 Laursen et al.
2002/0164925 A1 11/2002 Swedek et al.
2004/0155667 A1 8/2004 Kesil et al.
2005/0030013 A1 2/2005 Terada et al.
2005/0048874 A1 3/2005 Swedek et al.
2005/0282322 A1 12/2005 Manens et al.
2006/0246822 A1 11/2006 Swedek et al.
2008/0186022 A1 8/2008 Lei et al.

FOREIGN PATENT DOCUMENTS

EP 0402527 12/1990
EP 0460348 12/1991
EP 0663265 7/1995
EP 0738561 10/1996
EP 0881040 12/1998
EP 0881484 12/1998
EP 1116552 7/2001
JP 62-144002 6/1987
JP 1-136009 5/1989
JP 3-295409 12/1991
JP 5-343501 12/1993
JP 7-091948 4/1995
JP 9-148413 6/1997
JP 2000-121344 4/2000
JP 2001-343205 12/2001
JP 2002-174502 6/2002
JP 2003-106834 4/2003
WO WO 01/46684 6/2001
WO WO 01/89765 11/2001

* cited by examiner

WAFER EDGE CHARACTERIZATION BY SUCCESSIVE RADIUS MEASUREMENTS

CROSS-REFERENCE TO RELATED APPLICATIONS

This application claims the benefit of priority from Provisional Application No. 60/974,783, filed Sep. 24, 2007, which is incorporated by referenced herein in its entirety.

TECHNICAL FIELD

The present disclosure relates generally to metrology for chemical mechanical polishing, and more particularly to systems and methods for eddy current metrology.

BACKGROUND

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate.

As layers of materials are sequentially deposited and removed, the uppermost surface of the substrate may become non-planar across its surface requiring planarization. "Planarizing" a surface is a process where material is removed from the surface of the substrate to form a generally even, planar surface. Planarization is useful in removing undesired surface topography and surface defects, such as agglomerated materials, crystal lattice damage, scratches, and contaminated layers or materials. Planarization is also useful in forming features on a substrate by removing excess deposited material used to fill the features and to provide an even surface for subsequent levels of metallization and processing. In addition, planarization is generally needed to planarize the substrate surface for photolithography.

Chemical mechanical polishing (CMP) is one accepted method of planarization. Conventionally, this planarization method involves holding a substrate on a carrier head and placing the substrate against a rotating polishing pad. The carrier head provides a controllable load on the substrate to push it against the polishing pad. The polishing pad can be either a "standard" pad or a fixed-abrasive pad. A standard pad has a durable roughened surface, whereas a fixed-abrasive pad has abrasive particles held in a containment media. A polishing liquid, which can include abrasive particles, is supplied to the surface of the polishing pad (also, some processes use "abrasiveless" polishing).

A variation of CMP, which is particularly useful for copper polishing, is electrochemical mechanical processing (ECMP). The ECMP process is similar to the conventional CMP process, but has been designed for copper film polishing at very low down and shear forces, and is therefore suitable for low-k/Cu technologies. In ECMP techniques, conductive material is removed from the substrate surface by electrochemical dissolution while concurrently polishing the substrate, typically with reduced mechanical abrasion as compared to conventional CMP processes. The electrochemical dissolution is performed by applying a bias between a cathode and the substrate surface and thus removing conductive material from the substrate surface into a surrounding electrolyte.

One problem in CMP or ECMP is determining whether the polishing process is complete, i.e., whether a substrate layer has been planarized to a desired flatness or thickness, or when a desired amount of material has been removed, or whether an underlying layer has been exposed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

Two techniques are used to compensate for variations in the polishing endpoint. In-line metrology systems are located outside a polishing station and measure the thickness of layers on the substrate before and after processing. Assuming the layer thickness is determined prior to polishing, the polishing time can be adjusted to provide more accurate control of the amount of material remaining on the substrate after polishing. In-situ systems monitor the substrate during polishing to measure the amount of material removed or to detect sudden changes in substrate characteristics that indicate that a layer has been exposed.

A recent in-situ endpoint detection technique induces an eddy current in a metal layer on the substrate and uses an eddy current sensor to monitor the change in the eddy current as the metal layer is removed.

SUMMARY

An in-line eddy current monitoring system generates a signal related to the thickness of a conductive region such as a conductive layer on a wafer. The in-line eddy current monitoring system may be used either prior to or subsequent to polishing the wafer using a chemical mechanical polishing system.

In general, in one aspect, the invention is directed to a polishing apparatus having one or more polishing stations for polishing of a substrate, the polishing stations operating with a plurality of polishing parameters, an in-line monitoring system including: a substrate holder to hold the substrate at a location away from the polishing stations, and a sensor to generate a signal based on a thickness of a layer of the substrate, wherein the sensor and the substrate holder are configured to undergo relative motion to position the sensor at three or more angularly separated positions adjacent the substrate edge and generate measurements at three or more angularly separated positions; and a controller to receive the signal from the sensor and control at least one of the plurality of polishing parameters in response to the signal.

Implementations of the invention may include one or more of the following features. The substrate transfer system may include a wet robot, and the substrate holder may be located along a path of the wet robot. The system may include a factory interface module with at least one port to receive the substrate from a cassette, and the substrate holder may be located in the factory interface module. The transfer mechanism may include a factory interface robot to transfer the substrate to and from the factory interface module. The eddy current monitoring system may include a probe. The interface robot may position the substrate in a first direction within the probe, moving the surface of the substrate across the probe, e.g. along a radius of the substrate. The interface robot may rotate the substrate with respect to the probe. The surface of the substrate may then be moved across the probe along a second direction different from the first direction. The system may include a cleaner, and the substrate holder may be located in the cleaner. The substrate holder may be located in the polishing apparatus. The system may include another substrate holder to hold the substrate at another location away from the polishing stations, another probe positionable proximate to the substrate in the another substrate holder to induce eddy currents in a conductive region of the substrate and generate another signal associated with a thickness of the conductive region, and the controller may control at least one polishing parameter of the chemical mechanical polisher based on the another signal from the another probe. The controller may be configured to cause the substrate transfer system to place the substrate in the substrate holder prior to or after placing the substrate in the polishing station.

In another aspect, the invention is directed to a system that includes a cleaner to receive polished substrates from a polishing apparatus and an eddy current monitoring system. The cleaner has a substrate holder, and the eddy current monitoring system has a probe positionable proximate to the substrate in the substrate holder to induce eddy currents in a conductive region of the substrate and generate signals associated with a thickness of the conductive region.

In another aspect, the invention is directed to a system that includes a factory interface module to receive substrates and an eddy current monitoring system. The factory interface module has a substrate holder, and the eddy current monitoring system has a probe positionable proximate to the substrate in the substrate holder to induce eddy currents in a conductive region of the substrate and generate signals associated with a thickness of the conductive region.

Implementations of the above inventions may include one or more of the following features. The system may include a controller to modify at least one polishing parameter of the polishing apparatus based on the signal from the probe.

In another aspect, the invention is directed to a chemical mechanical polishing system that has one or more carrier heads for holding a substrate during polishing, one or more polishing stations, a substrate holding station separate from the polishing stations, and an eddy current monitoring system having a probe, the probe to be positioned proximate to the substrate in the substrate holding station to induce eddy currents in a conductive region of the substrate and generate signals associated with a thickness of the conductive region.

In another aspect, the invention is directed to a system that includes a measuring station to hold a substrate, an eddy current metrology system, and a controller. The measuring station is positioned at a location away from a polishing pad of a chemical mechanical polishing apparatus. The eddy current metrology system has a probe to be placed in proximity to a conductive region of the substrate at the measuring station, a driver unit to excite the probe, and a sensor unit to generate an output signal associated with a thickness of the conductive region. The controller is configured to adjust one or more polishing endpoint criteria based on the output signal from the eddy current metrology system.

Implementations of the above inventions may include one or more of the following features. The location may be chosen from the group consisting of in the chemical mechanical polishing apparatus, in a substrate transfer system, in a cleaner, and in a factory interface module.

In another aspect, the invention is directed to a method in which a substrate is transported with a substrate transferring system to a measuring station located separate from a polishing station of a polishing apparatus, a probe of an eddy current system is positioned in proximity to the substrate at the measuring station, the probe is excited to induce eddy currents in a conductive region of the substrate, measurement signals are generated with the eddy current system associated with a thickness of the conductive region, and a polishing parameter of the polishing apparatus is controlled based on the signals from the eddy current system.

Implementations of the above inventions may include one or more of the following features. The substrate may be polished. The polishing step may occur prior to the transporting step so that the polishing parameter controls polishing of a subsequent substrate, or the polishing step may occur after the transporting step so that the polishing parameter controls polishing of the substrate.

In another aspect, the invention is directed to an article comprising a machine-readable medium storing instructions operable to cause one or more machines to perform the above methods.

The substrate can be at various stages of integrated circuit fabrication, e.g., the substrate can one or more deposited and/or patterned layers.

The details of one or more implementations of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
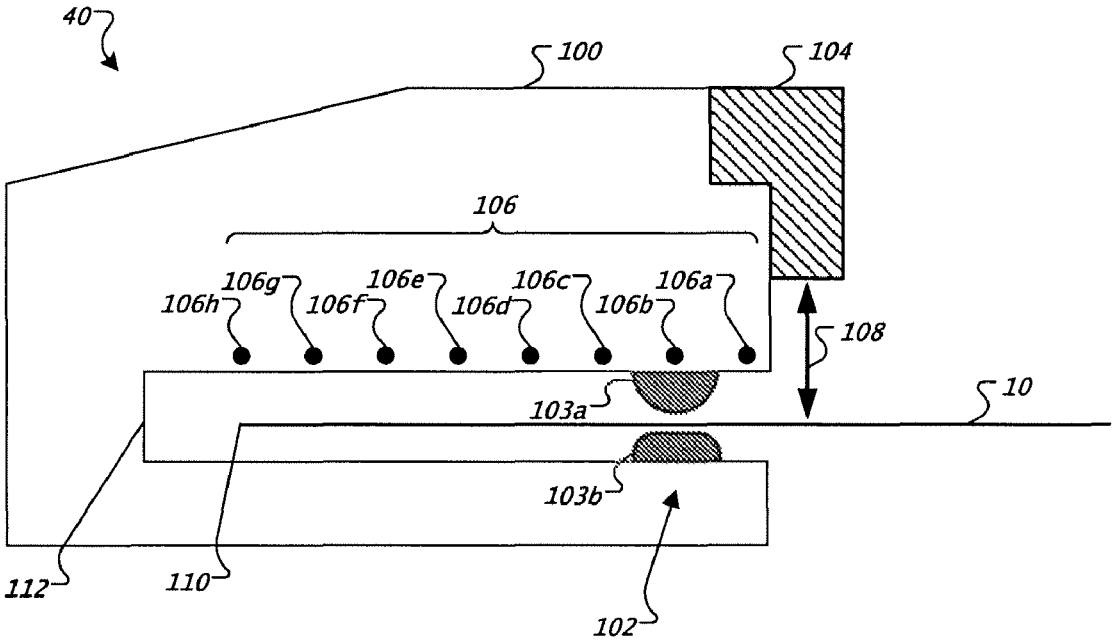
FIG. 1 illustrates an exemplary in-line eddy current metrology system.

In an ECMP system, an electrical bias can be applied between the substrate and the cathode. For example, the electrical bias can be applied by conductive contacts in a substrate support device, such as a substrate carrier head, that are in electrical communication with a substrate surface. As another example, the bias can be applied through a conductive polishing pad that is in contact with the substrate surface. An exemplary implementation of an ECMP system that can apply an electrical bias to the substrate surface can be found in co-pending U.S. Patent Application Publication 2005-0282322, also assigned to the assignee of the instant application, the entire disclosure of which is incorporated herein by reference.

Although the polishing of a circular substrate is usually axially symmetric, there can be angular variations in the polishing rate. The angular variations in the polishing rate can be more pronounced at the substrate edge. This effect can result in the angular variation of substrate layer thickness along the edge of the substrate. This variation, or unevenness of the substrate layer thickness, can affect the accuracy of determination of the thickness of a layer of the substrate or whether a layer has been uniformly removed from the substrate. In particular, if a monitoring system measures at only one radial segment through the substrate edge, it is possible that the measurement will be made in a region that varies from the average thickness at the substrate edge. If the measured substrate layer thickness is used to determine the amount of polishing needed by the substrate or control the polishing apparatus, this thickness variation can result in the overpolishing or underpolishing of the substrate.

The substrate can be scanned, for example, by an in-line eddy current monitoring system, as will be described below, that can generate a signal related to the thickness of a conductive region such as a conductive layer on a wafer. Measurements can be performed at multiple angularly separated regions, particularly at multiple angularly separated points near the substrate edge. In one implementation, multiple scans are performed along angularly separated radial segments of the substrate.

The thickness values of the multiple angularly separated points within a given radial range can be averaged together to determine an average thickness value for each radial zone of the substrate. This average value (including measurements from multiple angularly separated points within the radial range) can then be used for process control. For example, if the thickness of a metal layer of the substrate is measured before polishing, then the average value, particularly the average thickness value for the substrate edge, can be used to control the polishing system (e.g., the pressure applied by the carrier head) for that substrate to reduce within-wafer non-uniformity. If the substrate is being measured after polishing, then the average value, particularly the average thickness value for the substrate edge, can be used to control the polishing system (e.g., the pressure applied by the carrier head) for a subsequent substrate to reduce wafer-to-wafer non-uniformity.

Alternatively, the thickness values can be kept separate for angular analysis of the substrate. For example, if the substrate is being measured after polishing to determine whether a layer has been removed (e.g., whether an underlying layer has been exposed), then using multiple measurements spaced angularly about the substrate edge can improve reliability in determining that the layer has been completely removed. If a metal layer remains in some angular regions, then the system can determine that the substrate is underpolished and requires more polishing.

FIG. 1 illustrates an exemplary implementation of such an in-line eddy current metrology system 40. As shown in FIG. 1, the system 40 includes a housing 100 that supports an eddy current sensor 102, a vertical position sensor 104, and a horizontal position sensor 106. In this exemplary implementation, the horizontal position sensor 106 includes a plurality of optical position sensors 106*a-h*. The eddy current sensor 102 includes sensor heads 103*a* and 103*b*.

Figure 2:
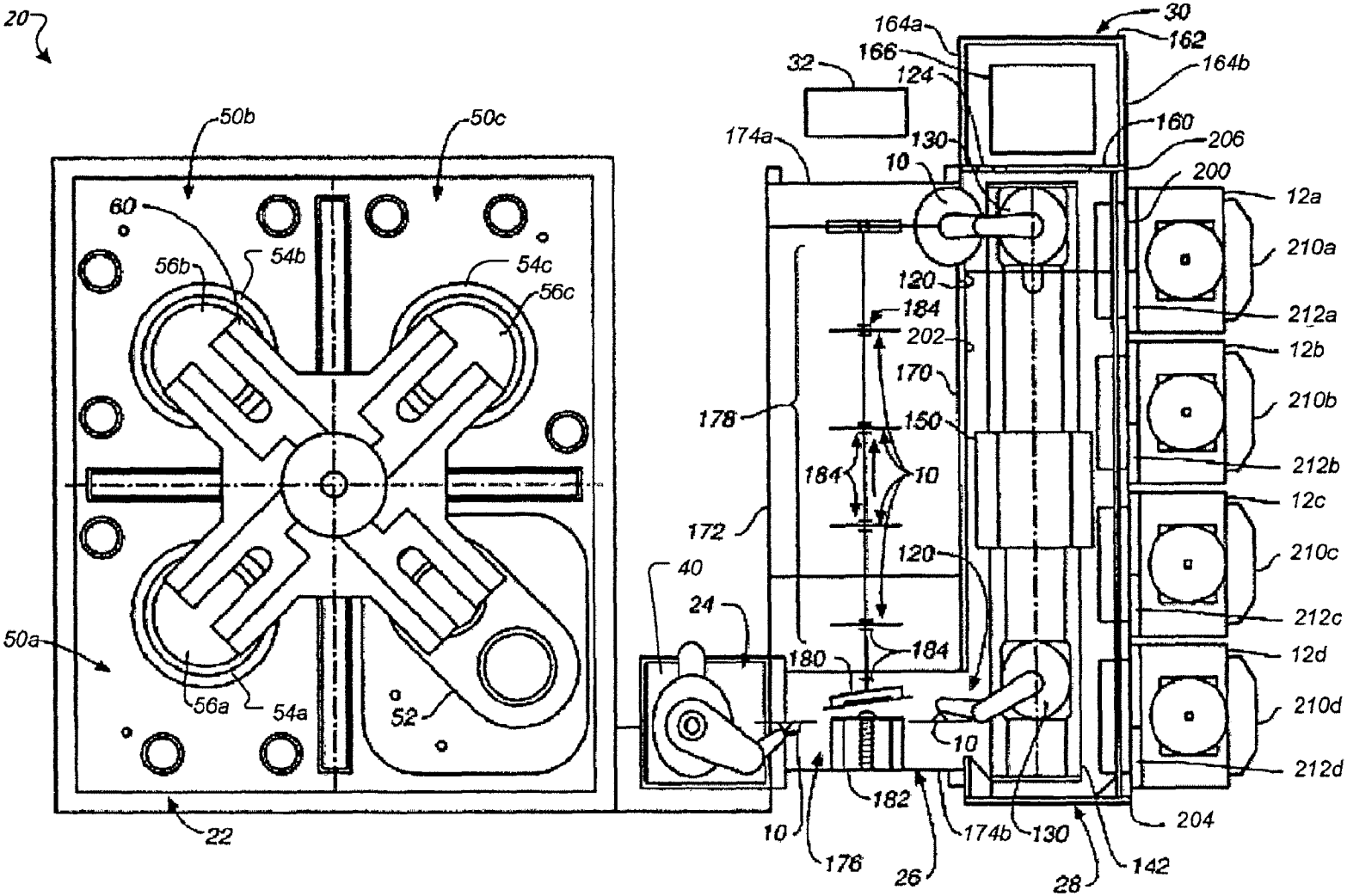
FIG. 2 illustrates an exemplary chemical mechanical polishing and cleaning system that includes the in-line eddy current metrology system shown in FIG. 1.

A substrate 10 can be introduced into the metrology system 40 in a generally horizontal position and moved laterally into the system 40, for example, by a robot (e.g., wet robot 24 as shown in FIG. 2) or other device designated for moving and/or manipulating substrates that may be included in a substrate processing system. During operation, the eddy current sensor 102 progressively scans the substrate 10 as it is moved into the system 40.

The vertical position sensor 104 can be used to determine vertical distance 108 (i.e., the distance measured from the bottom of the vertical position sensor 104 to the top of the substrate 10). The distance 108 (which may also be referred to as z-distance) is determined and fed to the robot to and used by the robot to adjust the substrate vertical position to ensure a consistent distance of the substrate to the sensor heads 103*a* and 103*b*, and/or fed to the eddy current sensor 102 to correct for inaccuracies in thickness measurements caused by distance variations of the substrate 10 from each of the sensor heads 103*a*, 103*b*. Eddy current sensing can be dependent on the distance between the substrate and the sensor heads. For example, the distance 108 can vary due to wafer vibration. The vertical position sensor 104 may perform a measurement of the distance 108 before the substrate 10 is placed fully into the probe 100 and scanning is started. This could occur when the substrate edge 110 is detected by the position sensor 106*a*. The robot used to handle the substrate 10 can then be commanded to adjust the vertical position of the substrate 10.

The horizontal position sensor 106, in some implementations, can determine the lateral location of the substrate 10 at fixed positions within the system 40. For example, the horizontal position sensor 106 can track the lateral substrate movement of the substrate 10 from its initial entry into the system 40 to its ending position within the system 40. In some implementations, the position sensors 106*a-h* are located at fixed, predetermined locations within the system 40. Each position sensor can be equally spaced relative to the other position sensors.

The eddy current sensor 102 senses the substrate 10 as it enters the system 40, taking continuous measurements of the substrate 10 at discrete points along the substrate 10. Substrate thickness can be determined at the discrete measurement points along the scanned radius of substrate 10. The substrate 10 can be a 200 mm diameter circular substrate, a 300 mm diameter circular substrate, or a substrate having another diameter. In some implementations, the substrate can be non-circular.

In some implementations, the position sensors 106*a-h* can be spaced 25 mm apart. During operation, the position sensor 106*a* detects the presence of the substrate edge 110. This detection can be used as an indication of the start of a substrate scan. Also, as described above, the substrate vertical position may now be adjusted. Next, the substrate is moved through the gap between the opposing sensor heads 103*a*, 103*b*. Eddy current sensor measurements of the substrate thickness are progressively taken as the substrate 10 passes through the eddy current sensor 102. In addition, as the substrate is scanned, substrate edge 110 is detected by each successive position sensor 106*b*-106. In some implementations, multiple eddy current sensor measurements are taken by the system 40 when the substrate 10 travels between each position sensor 106*a-h*. Eddy current sensor measurements can be taken at 1 mm increments along the substrate 10 during a predetermined time period so as to obtain a total of twenty-five eddy current measurements that span the 25 mm distance between each position sensor 106*a-h*.

In some implementations, this measurement process continues until substrate scanning stops, when a radius of the substrate (e.g., from substrate edge to center of the substrate) has been measured, when multiple angularly separated radial segments have been measured, or when a substantial number of locations near the substrate edge have been measured. In this example, assuming the substrate 10 is a 300 mm substrate, the system 40 scans the radius of the 300 mm substrate to obtain measurements at 150 measurement points (e.g., measured at each 1 mm). A substrate processing system that can employ the in-line eddy current metrology system 40 shown in FIG. 1 is depicted in FIG. 2. Referring to FIG. 2, the substrate processing system 20 includes a chemical mechanical polisher 22, a cleaner 26, a factory interface module 28, the in-line eddy current metrology system 40, a substrate transfer system 30, and a controller 32. A description of a similar substrate processing system can be found in U.S. Pat. No. 6,413,145, the entire disclosure of which is incorporated herein by reference in its entirety.

Substrates 10, e.g., wafers, can be transported to the substrate processing system 20 in wafer cassettes 12 (e.g., cassettes 12*a*-12*d*, collectively referenced as wafer cassettes 12). The substrate transfer system 30 includes a factory interface robot 130 to move substrates from cassettes (e.g., wafer cassette 12) to a holding station 150 or from the output of the cleaner 26 back to the cassettes, and a wet robot 24 to move substrates between the holding station 150, the polisher 22, and the input of the cleaner 26. The substrates are extracted from the cassettes 12 by the factory interface module 28 for transport to the polisher 22, and the cleaner 26. The operations of the substrate processing system 20 can be coordinated by controller 32, such as one or more programmable digital computers executing distributed control software.

The in-line eddy current metrology system 40 can be located in an area near the cleaner 26 and the polisher 22, such as proximate the wet robot 24, although a different suitable location for the in-line eddy current metrology system 40 may be used. The wet robot 24 can be configured to position the substrate 10 into the system 40. The wet robot 24 can hold the substrate 10 with a vacuum chuck or an arm having a gripper, and can be configured to extend and retract horizontally and vertically, as well as rotating about a vertical axis.

Alternatively, the substrate 10 could be laterally moved into the system 40 by the factory interface robot 18. For example, the system 40 could be located in the factory interface module 28, e.g., as part of the temporary storage 150 or as a system suspended in the interface module 28, or be a module 30 that abuts the factory interface module 28. The system could be place located in other, and other robots or devices could move the substrates into the system 40.

The controller 32 can be a digital computer connected to other components of the system 20, including the polishing system 22, as well as the in-line eddy current monitoring system 40. The controller 48 may be programmed to control the robot holding the substrate, e.g., wet robot 24, to move the substrate 10 through the monitoring system 40, to store substrate lateral and vertical position information in relation to the system 40 as determined by horizontal position sensor 106 and vertical position sensor 104, to store the signals received from the monitoring system 40, and to determine the thickness of the conductive layer 12 at different points on the substrate from the signals. In one implementation, the wet robot 24 can maneuver the substrate 10 to a correct position within the probe 100, and can move the substrate 10 laterally into the probe 100 at a determined rate of movement.

The in-line eddy current metrology system 40 can be configured to measure the thickness of a conductive layer on the substrate 10 before and/or after polishing of the substrate 10 by the polisher 22. The substrate 10 can be transferred to the system 40 by wet robot 24 at specific points during the polishing process to determine if further polishing of the substrate is needed.

Wet robot 24 may be similar to the factory interface robot 130, and can provide a wide range of motion to manipulate the substrate when transporting it between the staging section 176 and the polisher 22. For example, the wet robot 24 can be configured to position the substrate 10 into the eddy current metrology system 40. The wet robot 24 can hold the substrate 10 with a vacuum chuck or an arm having a gripper, and can be configured to extend and retract horizontally and vertically, as well as rotating about a vertical axis.

In some implementations, disposing the factory interface unit, polisher, cleaner and in-line eddy current metrology system in a single integrated system, monitoring of the polishing of individual substrates can be performed as part of the standard set of processing steps performed at the processing system.

The value for the vertical distance 108 can be sent to the controller 32, and in response, the controller 32 can direct the wet robot 24 to adjust the substrate position in the system 40 to correct for substrate vibration, for example. As discussed previously, the eddy current sensor 102 can sense the substrate 10 as the substrate 10 enters the system 40, taking a sequence of measurements of the substrate 10 at discrete points along a radius of the substrate. The controller 32 can receive these measurements, and can determine a corresponding substrate layer thickness associated with each discrete measurement point. For example, the eddy current metrology system 40 can scan a 300 mm substrate, and send signals and data to the controller 32 at 1 mm increments along the substrate 10. The signals and data can contain, for example, substrate lateral position information (e.g., 25 mm past the eddy current sensor 102), an eddy current voltage from the eddy current sensor 102, and the vertical height of the substrate 10 with respect to the eddy current sensor 102 (e.g., distance 108). Details describing how eddy current voltage can be detected and correspondingly generated as eddy current data can be found, for example, in U.S. Pat. No. 7,112,960, the entire disclosure of which is incorporated herein by reference in its entirety.

Figure 6:
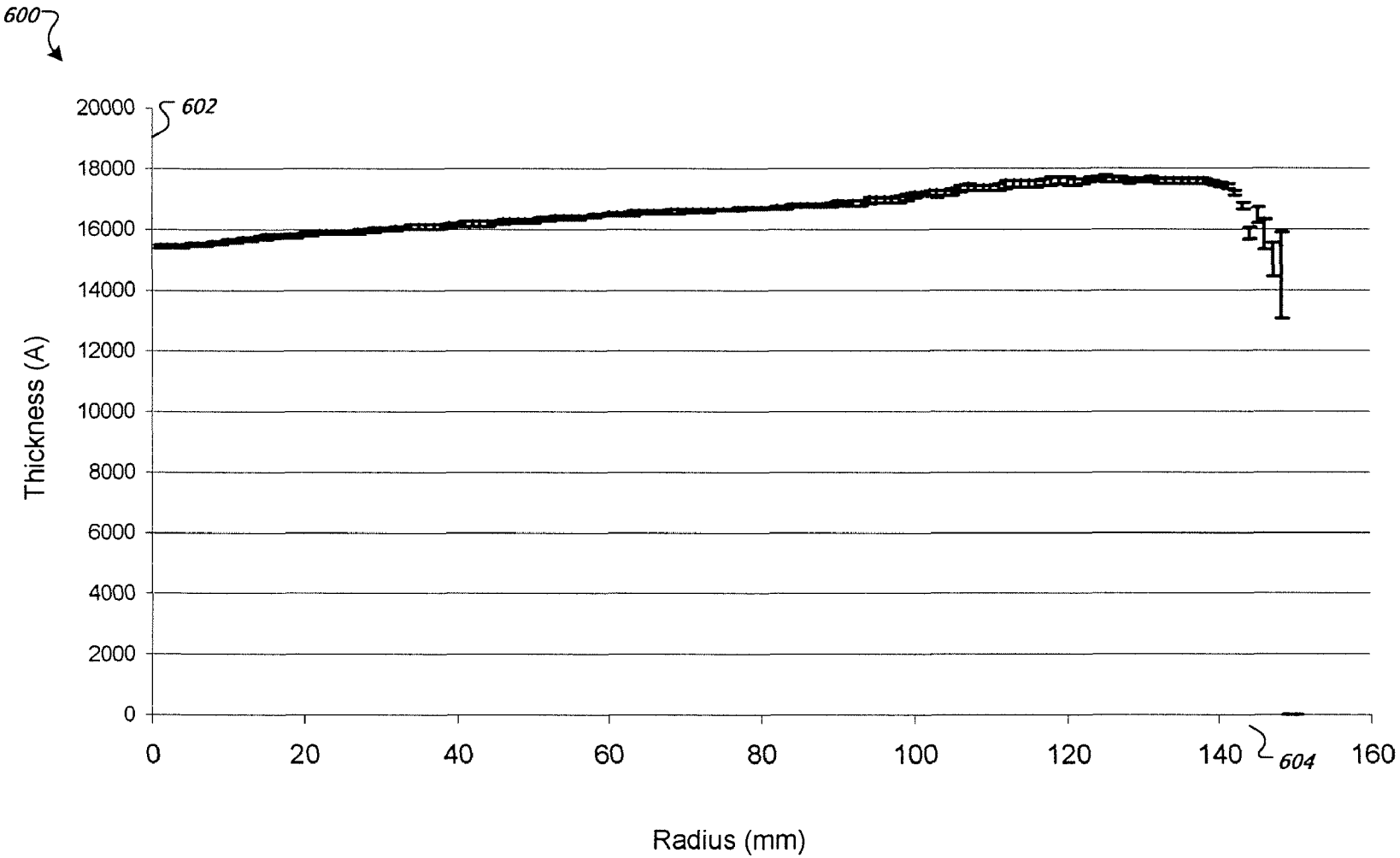
FIG. 6 shows an exemplary graph of substrate thicknesses along a radius of a substrate.

These signals and data points can be processed by signal processing algorithms to determine a substrate layer thickness measurement at each point measured along the substrate 10. FIG. 6, which will be described in more detail below, shows an exemplary graph of measured substrate layer thicknesses plotted against the location along the radius of the substrate 10.

Figure 3:
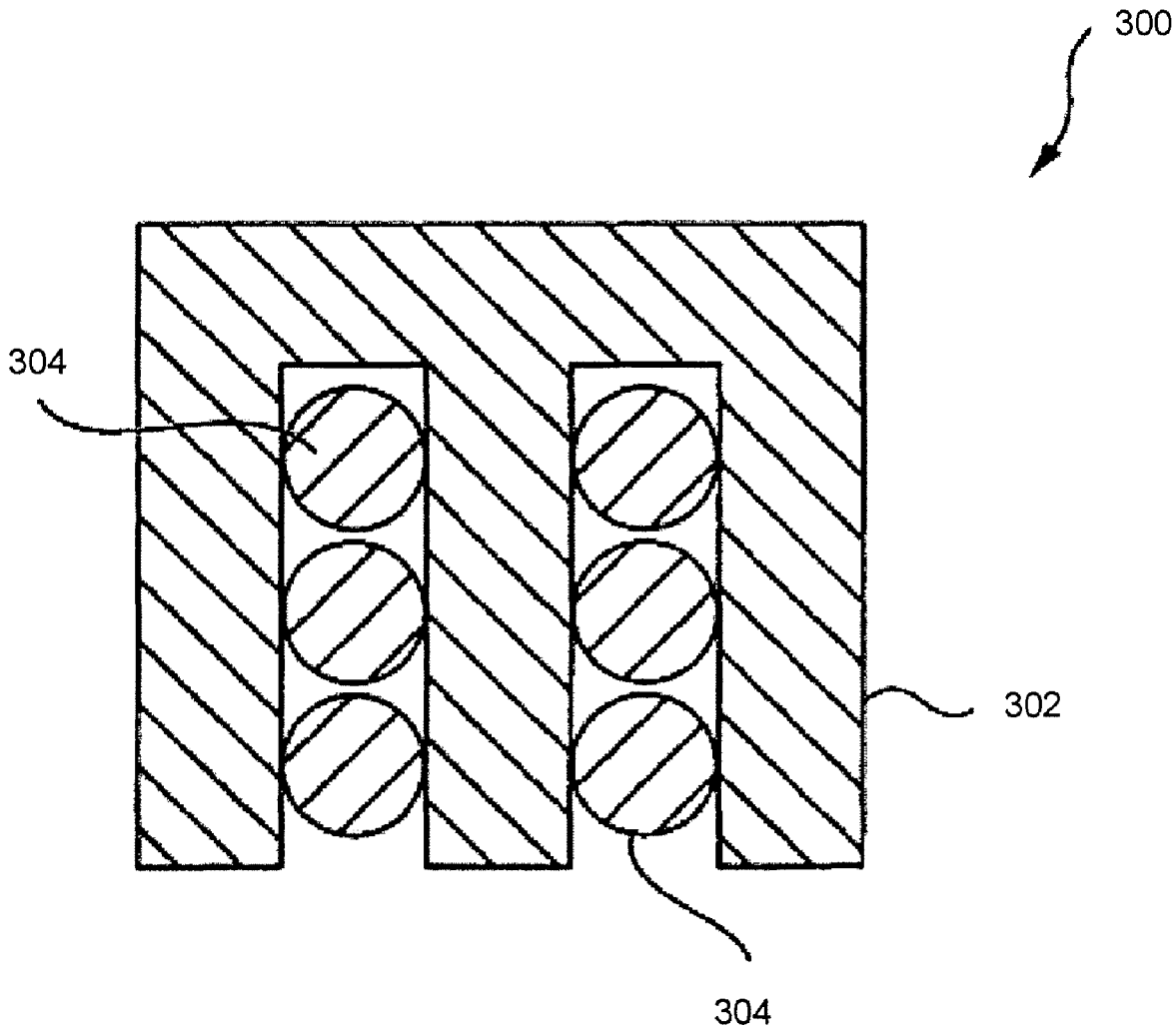
FIG. 3 illustrates an exemplary eddy current sensor head that can be used an eddy current sensor.

FIG. 3 illustrates an exemplary eddy current sensor head 300 that can be used in an eddy current sensor (e.g., eddy current sensor heads 103*a*, 103*b* in eddy current sensor 102 as shown with reference to FIG. 1). The eddy current sensor head 300 can include a pot core 302 and a coil 304. In some implementations, the core 302 can be a split ferrite pot core. For example, in one implementation, the core 302 can have a diameter of about 9 mm and a height of about 4 mm. In other implementations, the core can have other configurations and sizes. For example, in some implementations, the coil 304 can include 26-32 gauge wire and have about 10-30 turns. In other implementations, different wire sizes and coil configurations can be used.

The sensor coil 304, when driven by an AC current, can generate an oscillating magnetic field that induces an eddy current in the surface of the conductive layer of the substrate. The eddy current generated can be dependent on the strength of a magnetic B-field created by the AC current and the impedance of the conductive layer, which is related to the thickness and resistivity of the conductive layer. The thickness of the layer can therefore be determined based on the known resistivity and the eddy current detected by the sensor coil.

In some implementations, other types of eddy current sensor heads can be used. For example, the sensor heads can include two coils where a primary coil is driven by an AC current and generates an oscillating magnetic field, and a secondary pickup coil receives a responsive signal from the test object.

Figure 4A:
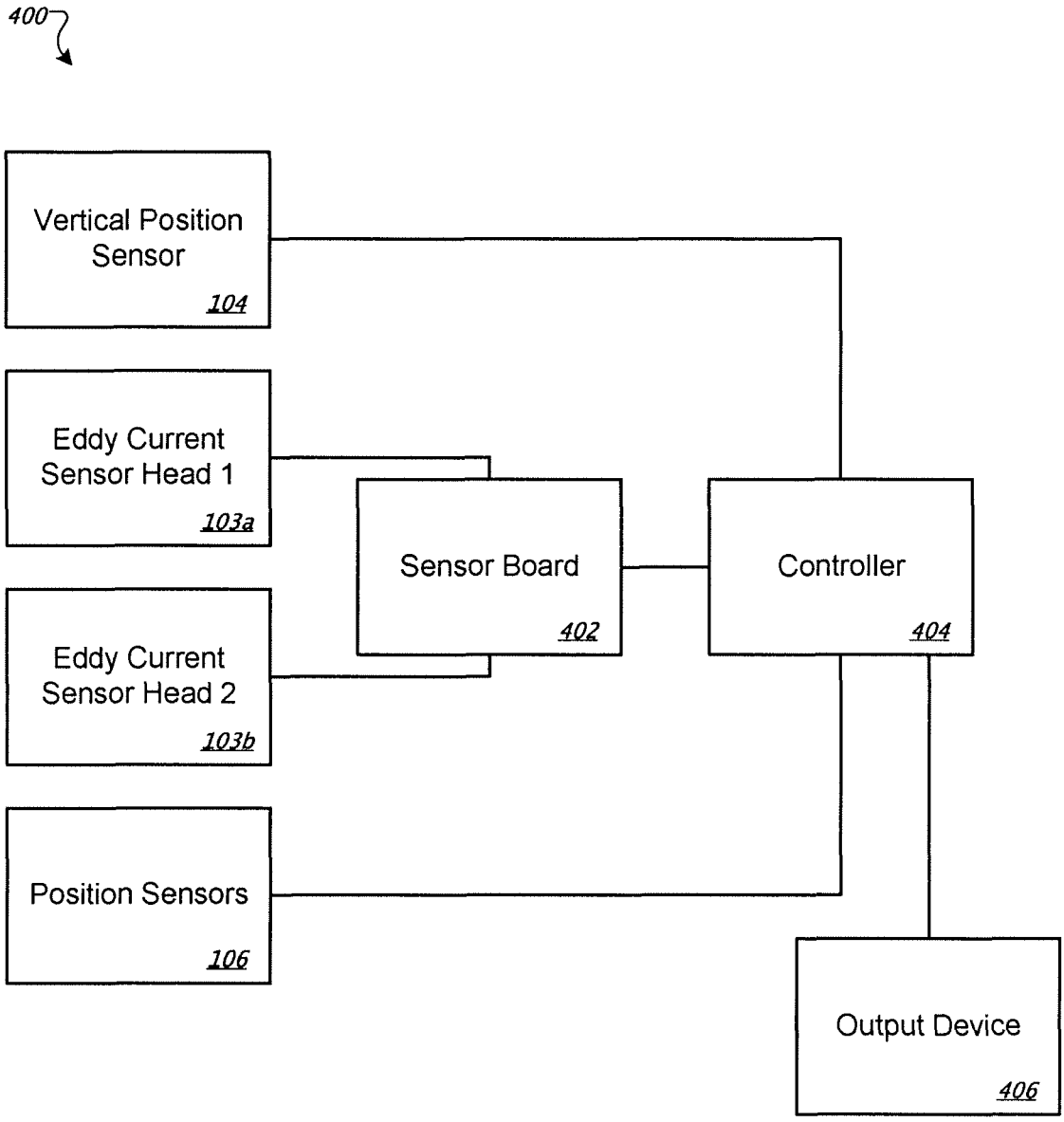
FIG. 4A is a block diagram of the exemplary in-line eddy current metrology system of FIG. 1.
Figure 4B:
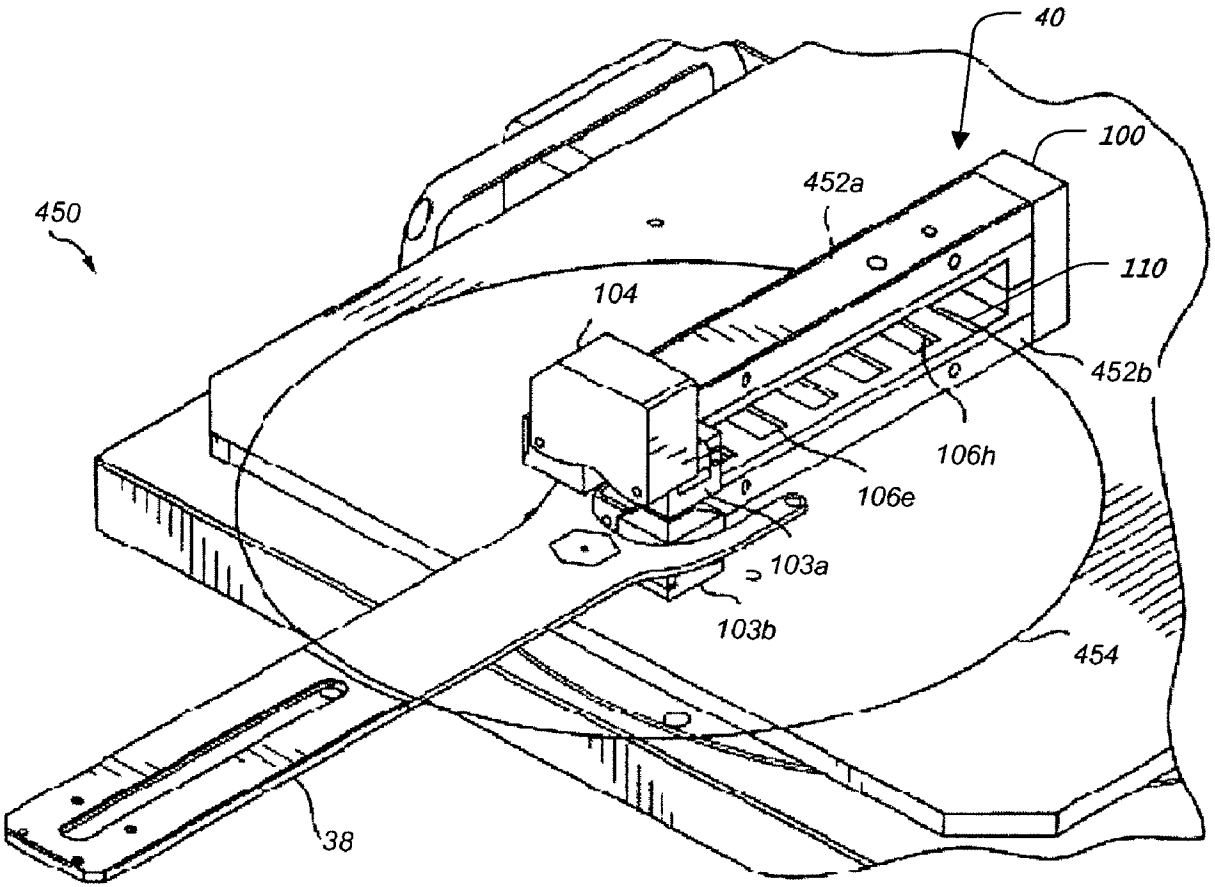
FIG. 4B is a perspective view of the exemplary in-line eddy current metrology system of FIG. 1.

FIG. 4A is a block diagram 400 of the exemplary in-line eddy current metrology system 40 of FIG. 1. FIG. 4B is a perspective view 450 of the exemplary in-line eddy current metrology system 40 of FIG. 1. Referring to FIGS. 4A and 4B, the system 40 can include the eddy current sensor 102, which includes sensor heads 103*a*, 103*b* that can be connected in either a serial or parallel circuit. The sensor heads 103*a*, 103*b* can be mounted on brackets 452*a*, 452*b* respectively, such that the heads 103*a*, 103*b* are spaced a predetermined distance from each other, forming a gate or gap there between. The gate distance can be varied depending on the size of the substrate being measured. For example, a range for use in semiconductor manufacturing for measuring the thickness of layers deposited on semiconductor wafers can be between about 2-6 mm. This range can provide suitable spot size, signal strength and handling reliability in typical semiconductor processing applications.

The eddy current sensor heads 103*a*, 103*b* can be connected to a sensor board circuit 402, which can generate an AC current for driving the sensor heads 103*a*, 103*b*. The sensor board circuit 402 can also receive a pickup eddy current signal from the sensor heads 103*a*, 103*b* indicative of the substrate conductive layer thickness. The pickup eddy current signal with voltage form can be transmitted to a controller 404, which can include an analog to digital converter for converting the pickup signal to a digital signal for processing, as will be described below.

The AC current used to drive the sensor coils (e.g., coil 304) can vary. In some implementations, the driving current can be at frequencies between about 300 kHz and 5 MHz. In other implementations, different current values may also be possible.

The eddy current metrology system 40 can also include the array of position sensors 106*a-h*, which can detect the position of the substrate 10 as it is moved through the gap between the eddy current sensor heads 103*a*, 103*b*. The position sensors 106 can be connected to the controller 404, which can determine the sampling locations on the substrate when thickness measurements are made. In some implementations, a position sensor can be an optical sensor, such as a through-beam type sensor. Examples of suitable position sensors can include the model EX-11 sensor commercially available from SUNX of Japan.

In some implementations, the vertical position sensor 104 (which can also be referred to as a z-position sensor) can measure the distance between the substrate 10 and the sensor heads 103*a*, 103*b* to determine a distance related compensation factor that can be applied to raw data generated by the eddy current sensor 102 to compensate for distance and vibration effects. Examples of suitable vertical position sensors can include a laser distance sensor. Examples of such a sensor can include the model XZ-30V sensor commercially available from OMRON of Japan.

The controller 404 can compute the thickness of the substrate conductive layer at various sampling locations based on respective readings from the sensors 106. In some implementations, the controller 404 can include an analog to digital converter, a PLC (Programmable Logic Control), and a PC (personal computer). The analog to digital converter can convert analog signals from the eddy current sensor 102 and the vertical position sensor 104 to digital form for processing. The PLC can receive sensing signals from the sensors 106 and can perform data logging or collection functions. The PC can receive data from the PLC and can perform measurement and compensation calculations. In some implementations, the measurement results can be output to an output device 406 (e.g., a computer display or printer). In some implementations, the controller 404 may feed data to or be a part of the controller 32 (as shown in FIG. 1), which can also control the movement of the wet robot 24 in the substrate processing system 20. The wet robot 24 can maneuver the substrate 10 to a correct position within the probe 100, and can move the substrate 10 laterally into the probe 100 at a determined rate of movement.

Various methods can be used for computing the thickness of the substrate 10 from the eddy current sensor readings. For example, one such method can use empirical data of eddy current sensor readings taken of particular substrates having known conductive layer thicknesses to generate sensor reading calibration curves. Eddy current sensor readings can then be mapped to calibration curves to determine the thickness of measured conductive layers. This will be described in more detail later in FIG. 9.

For example, referencing FIG. 1 and FIG. 4B, the eddy current metrology system 40 can be used to determine the thickness of a conductive layer on the substrate 10. The wafer can be positioned on an end effector 38 connected to a robotic arm (e.g., the wet robot 24 of FIG. 2). The robotic arm can then be actuated to move the wafer through the gate formed by the pair of eddy current sensor heads 103*a*, 103*b*. As the wafer moves through the gate formed by the pair of eddy current sensor heads 103*a*, 103*b*, it passes the array of position sensors 106, which can be successively tripped or actuated by the leading edge (e.g., substrate edge 110) of the wafer. A sensing routine can be triggered when the wafer passes the first position sensor 106*a*. The sensing routine can include the eddy current sensor 102 taking periodic thickness readings (e.g., at a sampling rate of 1,000 readings/second), and the position sensors 106 detecting when the wafer edge (e.g., substrate edge 110) passes each successive sensor to determine the velocity of the wafer. Using this information, the controller 404 can determine the measured thickness at each sampling location and the position of each sampling location on the wafer. In this manner, thickness measurements can be taken along a given line extending across the wafer. Measurements along different lines across the wafer can be taken, if desired, by rotating the wafer to a desired position and then moving it through the system 40 while making measurements. This will be described in more detail in FIG. 5.

In some implementations, the eddy current metrology system 40 can take measurements on-the-fly, i.e., while the wafer is being moved through the gap between the sensor heads 103*a*, 103*b*. High sampling rates can then be possible, allowing the wafer thickness to be quickly measured. In some implementations, a wafer having a diameter of about 300 mm can be measured in about two seconds, at about 2,000 sampling points. In other implementations, different sampling rates can be used resulting in more or less sampling points corresponding to shorter or longer measurement times, respectively.

In some implementations, by using two eddy current sensor heads (e.g., sensor heads 103*a*, 103*b*) on opposite sides of the substrate 10, inadvertent movement of a given sampling location toward or away from the sensor heads (resulting from movement of the substrate through the gap between the sensor heads) may not significantly affect the measurement. This can allow for more accurate measurements to be made at each sampling location. Also, extensive positioning control mechanisms may no longer be needed, resulting in quicker measurements. Sensor readings can be continually made as the substrate moves through the gap between the eddy current sensor heads.

In some implementations, quick and accurate measurements of the thickness of the conductive layer on a wafer can allow for corrective action to be taken, if needed, to obtain a desired conductive layer thickness. For example, if a generally uniform thickness of the conductive layer is desired and the measurements indicate that the thickness is not sufficiently uniform, the wafer can be subjected to selective chemical mechanical polishing, electrochemical mechanical polishing, or other processes to obtain the desired uniform thickness. In some implementations, for example, the controller 404 may be programmed to adjust the polishing process of the polisher 22 based on the measured layer thickness of the substrate 10, or the controller 404 may feed data to the controller 32 to perform this function. The polishing process of polisher 22 may be adjusted by modifying, for example, the de-plating voltage. In other implementations, a single controller may be used to perform functions related to controlling eddy current metrology system 40 and other portions of substrate processing system 20.

The thickness of the conductive layer of a substrate wafer can be measured prior to polishing of the wafer. For example, the controller 404 can receive the signals from the sensor board 402 associated with the thickness of the conductive layer. The controller 404 can use the data to adjust the polishing parameters or the polishing endpoint algorithm of the polisher 22. Alternatively or in addition, the thickness of the conductive layer of a substrate can be measured after polishing of the substrate. The controller 404 can use the signal to adjust the polishing parameter or endpoint algorithm for subsequent substrates. In some implementations, the controller 404 can feed the sensor data to controller 32 which can control the substrate processing system 20 for the polishing of the substrate.

Figure 5:
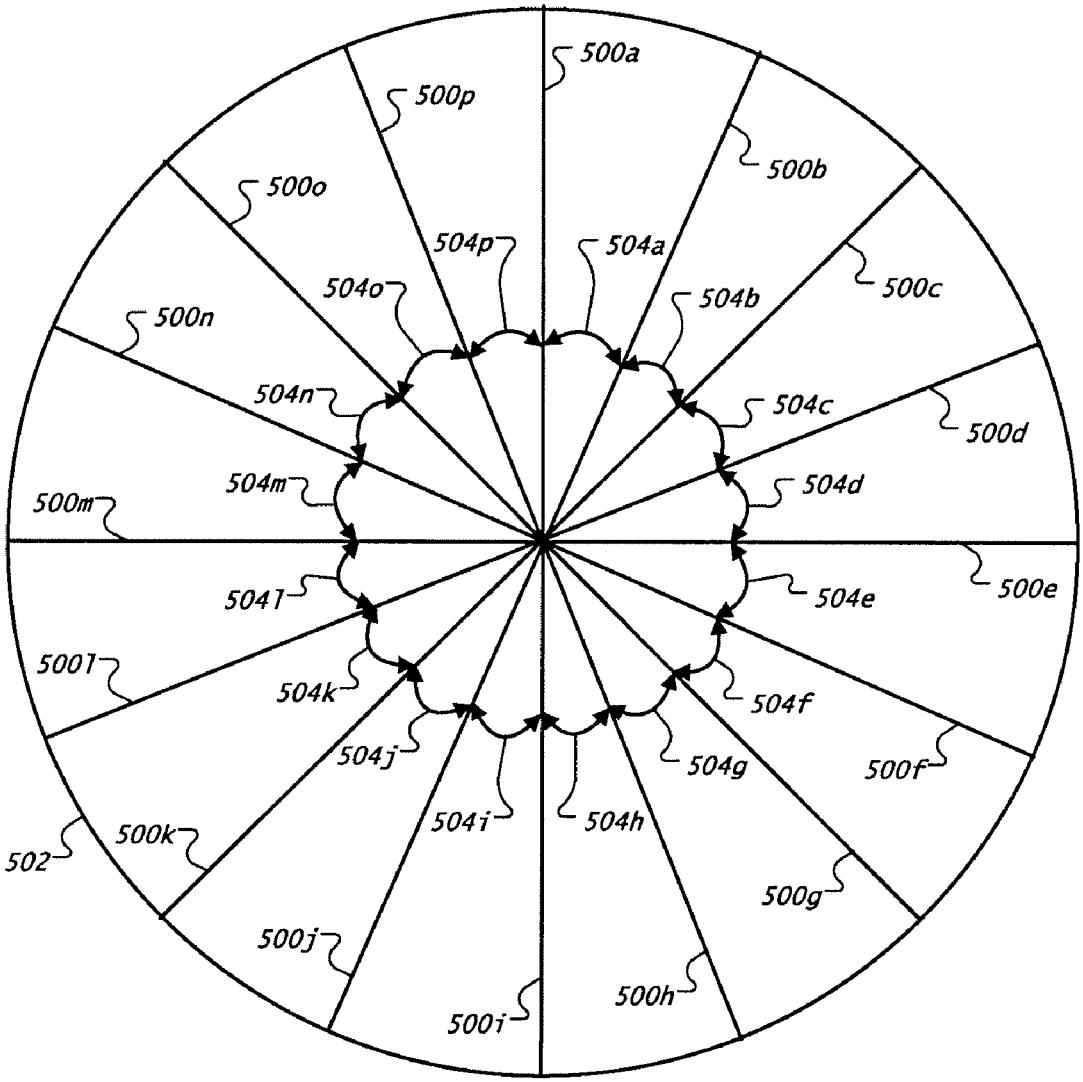
FIG. 5 illustrates exemplary radii on a substrate.

FIG. 5 illustrates an example of radii 500 on a substrate 502 that can be scanned by the system 40. In this example, substrate scanning is performed, and substrate thickness is determined, along the radii 500 of the substrate 502 as was described with reference to FIGS. 1, 4A and 4B. The radii 500 of the substrate 502 are equally spaced apart by an angle 504, α. Alternatively, the radii 500 can be variably spaced.

During operation, as the substrate 502 approaches towards the eddy current sensor (e.g., eddy current sensor 102), substrate scanning begins by scanning the substrate 502 along the radius 500*a* by the system 40 to obtain the substrate thickness profile associated with the radius 500*a*. Next, the substrate 502 is rotated counterclockwise by the value of the angle 504*a*. The substrate 502 is then scanned along the radius 500*b* by the system 40, and the substrate thickness profile along the radius 500*b* is determined. The substrate 502 is rotated again counterclockwise by the value of the angle 504*b*. The substrate 502 is then scanned along the radius 500*c* by the system 40, and the substrate thickness profile along the radius 500*c* can be determined. The substrate 10 can again be rotated by an angle α and scanned along another radius. In some implementations, this process continues until the substrate 10 has been rotated, e.g., clockwise or counterclockwise, by 360 degrees and all radii 500 have been scanned.

The angle, α, can be equally divisible into 360 degrees allowing for equal rotational increments along the circumference of the substrate 502. In the example shown in FIG. 5, the angle, α, is equal to 22.5 degrees. This results in the scanning of sixteen radii 500. In another implementations, angle, α, can be less than 22.5 degrees, for example, 2.5 degrees. This results in the scanning of one hundred and forty-four radii on the substrate. In another implementations, angle, α, can be greater than 22.5 degrees, for example, 45 degrees. A substrate can then be scanned along eight radii. In general, substrate thickness characterization may be more accurately depicted with a greater number of scanned radii. However, the scanning of more radii can result in a longer substrate thickness characterization process. The determination of the value of the angle, α, therefore may be a tradeoff between substrate thickness measurement accuracy and substrate scanning time. Six to twenty radii may be an appropriate number of scans to provide satisfactory accuracy.

Also, scanning is not limited to only scanning radii, and instead, can scan any particular length (e.g., diameter) across the substrate to collect a sufficient number of measurements. Moreover, if the substrate is rotable by the robot, then scanning can be performed along an arc, particularly an arc near the substrate edge where axial thickness variations are more likely to occur.

The results of the scanning of each of the radii can be collected together and averaged to determine the average thickness for the substrate layer. For example, the results of the scanning of one radii can be averaged to determine the average thickness of the substrate layer along that radii. This can be done for each radii scanned. The average thickness for each radii can then be collected and averaged to determine the average thickness of the substrate layer. In another example, the results of the scanning of each of the radii can be collected together. Once all radii have been scanned, all of the results can be summed together for different radial zones, and the measurements for each zone can be averaged to determine an average thickness for the substrate for that zone.

FIG. 6 shows an exemplary graph 600 of substrate layer thicknesses along radii of a substrate measured by the metrology station of FIG. 1. The graph 600 illustrates substrate layer thickness measurements, in Angstroms, along the y-axis plotted against a location on the radius of the substrate, measured in millimeters (mm), along the x-axis 604, with error bars indicating the range of variation of thickness measurements for the particular radius. The radius spans from the center of the substrate to the substrate edge. The substrate measured, in this example, is a 300 mm substrate, and therefore, the radius of the substrate is 150 mm.

The graph 600 illustrates the edge effect on a substrate surface, described earlier. As shown, the thickness at the edge is generally greater than that at the center of the substrate, excepting at the very edge. In addition, as shown, the variation in thickness is greated at the very edge of the substrate.

Accordingly, in some implementations, multiple measurements of a substrate can be taken at different radii along the substrate surface, as described with reference to FIG. 5. Each radius measured can result in thickness measurements different from those shown in the graph 600. As discussed above, the thickness measurements taken at the various radii along the substrate surface can be averaged together within various radial zones (particularly the edge zone) to obtain average values that take into account of the angular variations of the substrate layer thicknesses within that zone, thus providing a more accurate measurement of the substrate layer thickness. Using the average thickness, polishing can be adjusted to ensure that the substrate achieves a desired planarized thickness profile.

Figure 7:
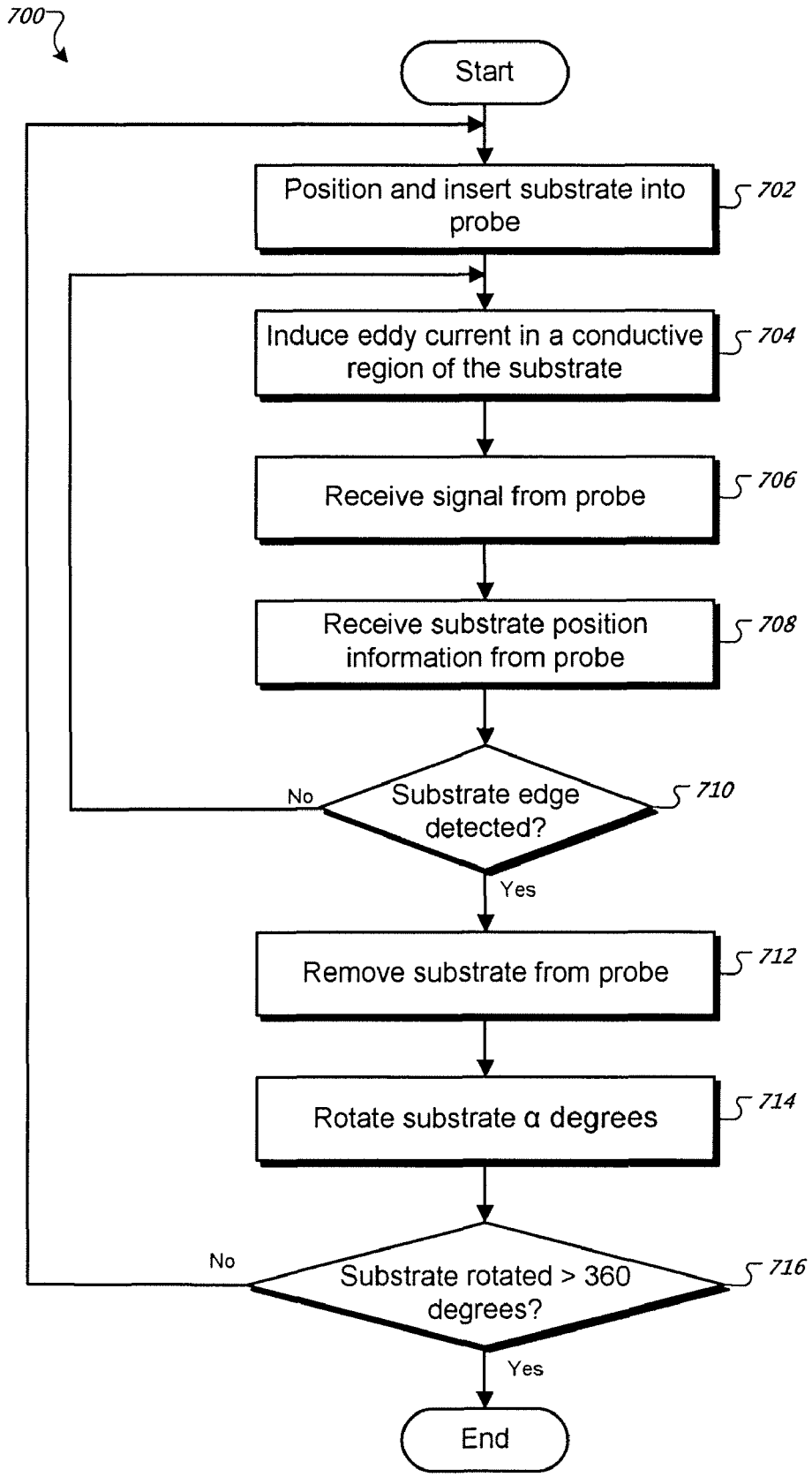
FIG. 7 is an exemplary flow chart for monitoring the thickness of a conductive region on a layer of a substrate.

FIG. 7 is a flow chart of a method 700 for monitoring the thickness of a conductive layer of a substrate. The method 700 can be performed in the eddy current metrology system 40, which is part of the substrate processing system 20, shown with reference to FIG. 1 and FIG. 2. The method 700 begins by positioning the substrate 10 proximate to the eddy current system 40 and inserting the substrate 10 into the system 40 (702). For example, the substrate 10 can be handled by the wet robot 24. As the wet robot 24 moves the substrate 10, eddy currents are induced in a conductive region of the substrate 10 as the substrate 10 passes the eddy current sensor 102 (704). The controller 48 receives a signal (706) which can be used to determine the thickness of the substrate at that measurement location.

Next, the controller 48 receives substrate position information from the in-line system 40 (708). If the substrate edge 110 is not detected (710), scanning is continued (704). If the substrate edge 110 is detected (710), the wet robot 24 removes the substrate from the system 40 (712). The wet robot 24 rotates the substrate 10 by an angle, $\alpha$ (714). The angle, $\alpha$, is a predetermined number of degrees of rotation in a counterclockwise direction. If the substrate 10 is rotated 360 degrees from the first radius scan of the substrate 10 (716), the method 700 ends. If the substrate 10 has not been fully rotated 360 degrees (716), the method 700 continues (702).

In an alternate implementation of the method 700, the wet robot 24 may be the factory interface robot 18 or another similar device used to grasp, move, and/or rotate a substrate within a substrate processing system. In another alternate implementation, the substrate 10 can be rotated in a clockwise direction.

Figure 8:
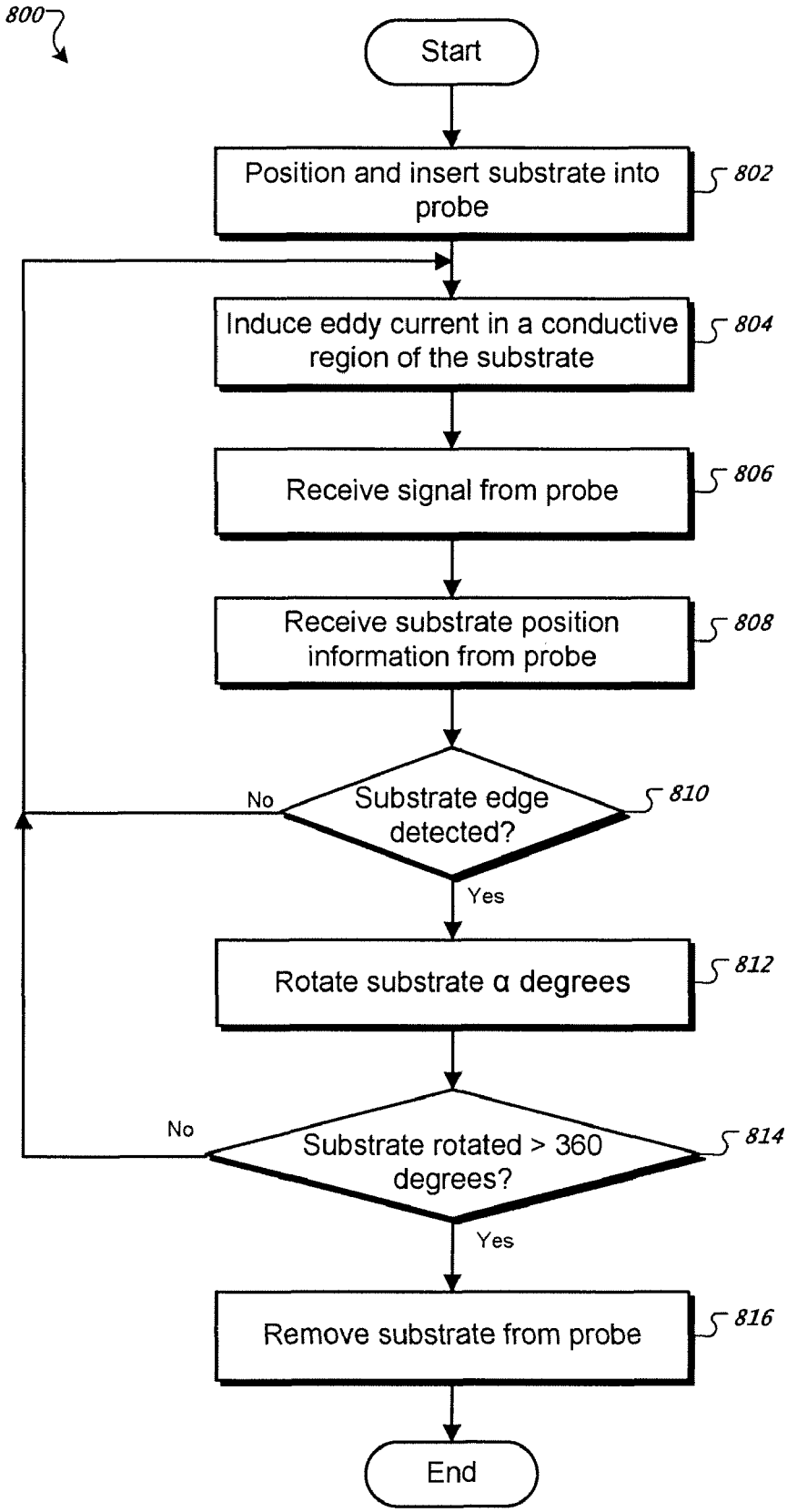
FIG. 8 is an exemplary flow chart of an alternative method for monitoring the thickness of a conductive region on a layer of a substrate.

FIG. 8 is a flow chart of an alternative method 800 for monitoring the thickness of a conductive region on a layer of a substrate. Essentially steps 802-810 are identical to steps 702-710 performed in the method 700. However, rather than removing the substrate 10 from the system 40 upon the detection of the substrate edge, the substrate 10 is rotated by an angle, $\alpha$ (812). The angle, $\alpha$, is a predetermined number of degrees of rotation in a counterclockwise direction. If the substrate 10 has been rotated 360 degrees from the first radius scan of the substrate 10 (814), the wet robot 24 removes the substrate 10 from the probe 100 of system 40 (816). Unlike the method shown in FIG. 7, the substrate 10 remains in the probe 100 until a number of measurements has been obtained.

Figure 9:
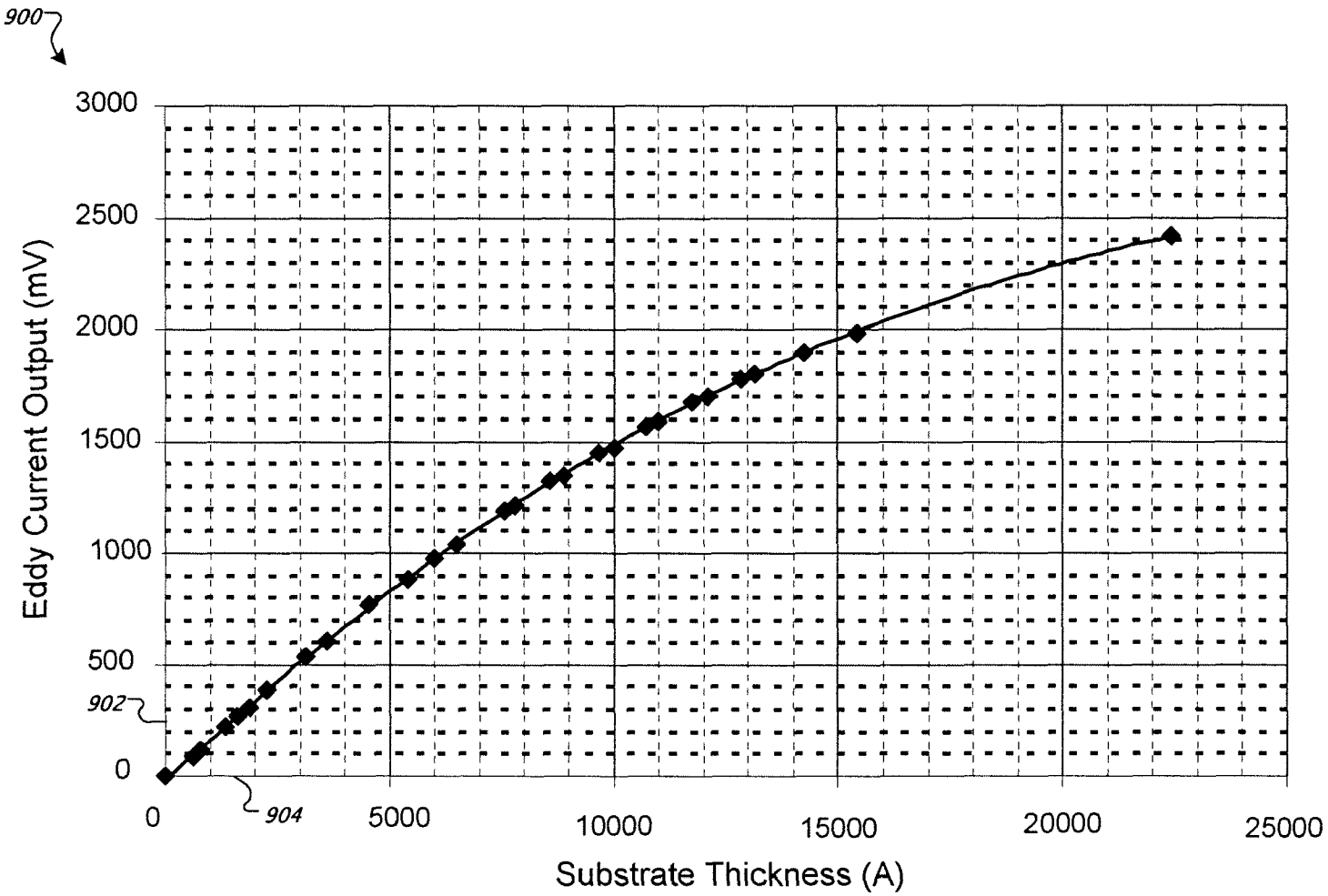
FIG. 9 is an exemplary graph of eddy current output for substrate thicknesses.

FIG. 9 is a graph 900 of eddy current output for substrate thicknesses. The eddy current output, in millivolts (mV), is shown on the y axis 902 plotted against wafer thicknesses, in Angstroms (A), along the x axis 904. The data illustrated in this figure can be used in the calibration of the eddy current metrology system 40.

The speed of movement of a manipulative handling mechanism (e.g., wet robot 24) used to move the substrate into and out of the system 40 can be optimized for minimum vibration level and constant speed during substrate scans.

As described with reference to FIG. 1, the vertical distance 108 of the substrate 10 within the system 40 can be calibrated. The calibration can be performed to locate the substrate within the probe 40 at an optimized position, where the eddy current measurement output is minimized. During calibration, multiple substrate scans can be performed for multiple vertical distance positions to determine the magnetic center of the eddy current sensor 102 and to calibrate the height compensation algorithm.

Substrates of known thickness can be scanned by the system 40 to correlate the eddy current voltage measured to the substrate thickness, as shown in the graph 900. The thickness range of the calibration substrate wafers can be used to define the range of measurement of the system 40. The measurement range and accuracy of the system 40 may be limited by the non-linearity of the eddy current sensor, as is illustrated in the graph 900 for substrate thickness values above 15,000 Angstroms.

Factors that can affect the calibration of the system 40 may be related to substrate doping and film resistivity variation. Substrate doping can result in an offset in the reading of the thickness of the substrate by affecting the eddy current sensor voltage value. Eddy current sensor voltage measurements can vary depending upon film conductivity. Non-annealed wafers can be re-calibrated in the system 40 before measurements are made to insure the accuracy of the thickness measurements.

The eddy current metrology system 40 can be located proximate to a measuring station, where the substrate is held in a substrate holder at the measuring station either prior to or subsequent to polishing the substrate. Referring to FIG. 2, the in-line eddy current metrology system 40 can be located in the area of the wet robot 24. This location is advantageous if a substrate is scanned after polishing, because it is located close to the polisher and little time elapses before the measurement is performed. In an implementation where an eddy current measurement is used to modify one or more processing parameters for polishing a subsequent substrate, this location allows for more rapid feedback to the polisher 22. The location is also functional if a substrate is scanned prior to polishing.

Another possible location for the in-line eddy current system metrology 40 is in the factory interface module 28. Locating an eddy current monitoring system in factory interface module 28 may be convenient when measuring a conductive layer prior to polishing. The factory interface robot 130 can place a substrate into the in-line eddy current metrology system 40 before placing the substrate in the storage station 50. The controller 34 can correlate the substrate data to its location in the storage station 50. Another possible location for the in-line eddy current system metrology 40 is in a module directly attached to the factory interface module 28.

Another possible location for the in-line eddy current monitoring system 40 is in the storage station 50 located in the factory interface module 28. The system 40 can be located above the slots 56, referring to FIG. 3. The factory interface robot 18 can place a substrate into the in-line eddy current metrology system 40 before placing the substrate in a slot 56. The controller 34 can correlate the substrate data to its location in the storage station 50.

Another possible location for the in-line eddy current metrology system 40 can include the input storage station 80 and the output storage station 82 in the cleaner 26. The eddy current metrology system 40 may be located proximate to the transfer station 27 of the polisher 22, or at another location in the polisher 22 where the thickness of a conductive region may be measured prior to and/or subsequent to polishing the substrate rather than during polishing.

In some implementations, a second eddy current metrology system 40 may be included at a second location in the system 20. For example, the system 40 may be located at the holding station 32, and may be used to measure the thickness of one or more conductive regions on a substrate subsequent to polishing. An additional eddy current metrology system may be located in the factory interface module 28, and may be used to measure the thickness of one or more conductive regions on a substrate prior to polishing. The two measurements may be compared. The system 40 and any additional system may share some elements, such as a controller 48, and/or part or all of the drive system 60, as shown with reference to FIG. 4.

The in-line eddy current metrology system 40 has several potential advantages. The system 40 provides a non-contact measurement technique that is suitable for opaque metal layers. The manipulative handling mechanism used to move the substrate within the probe 100 can move the substrate more slowly across the eddy current sensor 102 than in an in-situ monitoring process. Consequently, the sensor 102 can be capable of a high spatial resolution. For example, a scanning resolution of one data point per millimeter is possible. In fact, the information is comparable to a standard four-point probe (4PP) substrate conductive layer measuring system. Nonetheless, the manipulative handling mechanism used to move the substrate within the probe 100 of the system 40 can move the substrate sufficiently quickly under the sensor 102 that throughput of the polisher is not affected. For example, the wet robot 24 can move a substrate under sensor 102 gate between sensors 103*a*, 103*b* 100 mm (the radius of a 200 mm substrate) in less than one second. The number of radii scanned will determine the duration of the substrate scanning process.

The system can be simple, robust and inexpensive. The system can be positioned in an existing part of the polishing system, and consequently does not require a change to the layout of the polishing system or an increase in the footprint. The collected thickness data can be used to adjust the polishing process of the substrate being measured, or the polishing process of one or more subsequent substrates.

A number of implementations have been described. Nevertheless, it will be understood that various modifications may be made without departing from the spirit and scope of the invention. Accordingly, other implementations are within the scope of the following claims.

What is claimed is:

1. A system, comprising:

a polishing apparatus having one or more polishing stations for polishing of a substrate, the polishing stations operating with a plurality of polishing parameters;

an in-line monitoring system including a substrate holder to hold the substrate at a location outside the polishing stations, a housing having an opening for receiving the substrate, and an eddy current sensor outside the polishing stations and near the opening to generate a signal based on a thickness of a layer of the substrate, wherein the sensor and the substrate holder are configured to undergo relative motion; and a controller configured to cause the substrate holder to insert the substrate into the opening in the housing and to cause the sensor and substrate to undergo relative motion such that the sensor traverses a path including three or more angularly separated positions adjacent an edge of the substrate, the sensor configured to generate measurements at the three or more angularly separated positions, and the controller configured to receive the signal from the sensor and control at least one of the plurality of polishing parameters in response to the measurements.

2. The system of claim 1, wherein the sensor is stationary and the substrate holder is movable.

3. The system of claim 2, wherein the polishing apparatus comprises a carrier head and substrate holder comprises a robot other than the carrier head.

4. The system of claim 1, further comprising a substrate support outside the polishing station to hold the substrate at a location away from the polishing stations and the sensor.

5. The system of claim 4, wherein the substrate holder is operable to transfer the substrate from the substrate support to the sensor.

6. The system of claim 1, wherein the monitoring system includes a substrate edge detector.

7. The system of claim 6, wherein the monitoring system is configured to detect a first edge of the substrate and a second edge of the substrate as the substrate holder scans the sensor across the substrate.

8. The system of claim 1, wherein the substrate holder is located in the polishing apparatus.

9. The system of claim 1, wherein the monitoring system includes a vertical position sensor to determine a vertical position of the substrate; and wherein the substrate holder is configured to adjust the vertical position based on a signal from the vertical position sensor to prevent the substrate from contacting the sensor.

10. The system of claim 9, wherein the monitoring system includes a horizontal position sensor to track a lateral location of the substrate.

11. The system of claim 10, wherein the substrate holder is configured to adjust the lateral location based on a signal from the horizontal position sensor to prevent the substrate from contacting an inner wall of the opening.

12. The system of claim 10, wherein the monitoring system includes a plurality of horizontal position sensors spaced at fixed predetermined locations within the opening to track the lateral location of the substrate.

13. The system of claim 1, wherein the controller is configured to average measurements from each of a plurality of radial zones to generate an averaged measurement for each radial zone.

14. The apparatus of claim 1, wherein the path comprises a plurality of linear segments.

15. The system of claim 14, wherein the plurality of linear segments comprise three or more angularly separated radial segments of the substrate.

16. The system of claim 15, wherein the three or more angularly separated radial segments are evenly angularly spaced apart.

17. The system of claim 15, wherein the sensor is configured to generate measurements at a plurality of positions along each of the three or more angularly separated radial segments.

18. The system of claim 17, wherein the controller is configured to average the measurements for each of the radial segments to generate an averaged measurement for each of the radial segments and to control the polishing parameter based on the averaged measurement.

19. The system of claim 14, wherein the plurality of linear segments comprise between six and twenty angularly separated radial segments of the substrate.

20. A system, comprising:

a polishing apparatus having one or more polishing stations for polishing of a substrate, the polishing stations operating with a plurality of polishing parameters;

a monitoring system including a substrate holder to hold the substrate at a location away from the polishing stations, a sensor to generate a signal based on a thickness of a layer of the substrate, and an opening for receiving the substrate, wherein the sensor is positioned near the opening, wherein the sensor and the substrate holder are configured to undergo relative motion, and wherein the monitoring system is configured to detect a first edge of the substrate and a second edge of the substrate as the substrate holder scans the sensor across the substrate; and a controller configured to cause the sensor and substrate to undergo relative motion such that the sensor traverses a path, the sensor configured to generate measurements at three or more separated positions along the path, the controller configured to receive the signal from the sensor and control at least one of the plurality of polishing parameters in response to the measurements, and the controller is configured to cause the substrate holder to remove the substrate from the opening upon detection of the second substrate edge.

21. A system, comprising:

a polishing apparatus having one or more polishing stations for polishing of a substrate, the polishing stations operating with a plurality of polishing parameters;

a monitoring system including a substrate holder to hold the substrate at a location outside the polishing stations, and a sensor outside the polishing stations to generate a signal based on a thickness of a layer of the substrate, wherein the sensor and the substrate holder are configured to undergo relative motion, and wherein the monitoring system is configured to detect a first edge of the substrate and a second edge of the substrate as the substrate holder scans the sensor across the substrate; and a controller configured to cause the sensor and substrate to undergo relative motion such that the sensor traverses a path, the sensor configured to generate measurements at three or more separated positions along the path, the controller configured to receive the signal from the sensor and control at least one of the plurality of polishing parameters in response to the measurements, and the controller configured to cause the substrate holder to rotate the substrate by an angle $\alpha$ upon detection of the second substrate edge.

22. The system of claim 21, wherein the angle $\alpha$ equals 360/N, where N is an integer greater than 2.

23. A method comprising:

holding a substrate on a substrate holder;

inserting the substrate into an opening of a housing of an in-line monitoring system;

scanning an eddy-current sensor positioned near the opening across the substrate in the in-line monitoring system, the scanning including causing the sensor to traverse a path including three or more angularly separated discrete points adjacent an edge of the substrate;

generating a measurement signal associated with a thickness of the substrate at each of the three or more angularly separated discrete points from the sensor in the in-line monitoring system; and controlling a polishing parameter of a polishing apparatus based on the measurement signal.

24. The method of claim 23, wherein scanning the substrate includes moving the sensor along three or more angularly separated radial segments of the substrate, and generating a measurement signal includes measuring the substrate at one or more positions on each of the three or more angularly separated radial segments.

25. The method of claim 24, further comprising:

detecting a first substrate edge and a second substrate edge of the substrate, the second substrate edge being farther away from the sensor than the first substrate edge when the first substrate edge is detected.

26. The method of claim 24, further comprising:

generating measurement signals associated with thicknesses of the substrate at a plurality of discrete points on each of the three or more angularly separated radial segments;

averaging the measurement signals generated for each of the radial segments to produce an averaged signal for each of the radial segments; and controlling the polishing parameter based on the averaged signal.

27. The method of claim 24, wherein scanning the substrate includes moving the sensor along between six and twenty angularly separated radial segments of the substrate.

28. The method of claim 24, wherein the radial segments are evenly angularly spaced around the substrate.

29. The method of claim 23, further comprising averaging measurements from each of a plurality of radial zones to generate an averaged measurement for each radial zone.

30. A method comprising:

scanning a sensor across a substrate in a monitoring system to position the sensor at three or more angularly separated discrete points adjacent an edge of the substrate;

generating a measurement signal associated with a thickness of the substrate at each of the three or more angularly separated discrete points;

detecting a first substrate edge and a second substrate edge of the substrate, the second substrate edge being farther away from the sensor than the first substrate edge when the first substrate edge is detected;

rotating the substrate from a first radial segment to a second radial segment after detecting the second substrate edge; and controlling a polishing parameter of a polishing apparatus based on the measurement signal.

31. The method of claim 30, wherein rotating the substrate from the first radial segment to the second radial segment is performed without removing the substrate from an opening of the sensor.

32. The method of claim 30, wherein rotating the substrate includes removing the substrate from an opening of the sensor, rotating the substrate after removing the substrate, and returning the substrate to the opening.

33. The method of claim 30, wherein rotating the substrate includes rotating the substrate by an angle of 360/N degrees, where N is an integer greater than 2.

* * * * *

UNITED STATES PATENT AND TRADEMARK OFFICE

CERTIFICATE OF CORRECTION

PATENT NO. : 8,337,278 B2
APPLICATION NO. : 12/203726
DATED : December 25, 2012
INVENTOR(S) : Ignasi Palou-Rivera It is certified that error appears in the above-identified patent and that said Letters Patent is hereby corrected as shown below:

In the Claims:

In Claim 14, column 16, line 37, delete "The apparatus" and insert -- The system --.

Signed and Sealed this
Twenty-eighth Day of May, 2013

Teresa Stanek Rea
*Acting Director of the United States Patent and Trademark Office*